US006478086B1

(12) United States Patent
Hansen

(10) Patent No.: US 6,478,086 B1
(45) Date of Patent: Nov. 12, 2002

(54) METHOD FOR INSTALLING A SENSOR IN CONNECTION WITH PLUGGING A WELL

(75) Inventor: Henning Hansen, Randaberg (NO)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/673,475

(22) PCT Filed: May 3, 1999

(86) PCT No.: PCT/NO99/00144

§ 371 (c)(1),
(2), (4) Date: Oct. 16, 2000

(87) PCT Pub. No.: WO99/60250

PCT Pub. Date: Nov. 25, 1999

(30) Foreign Application Priority Data

May 4, 1998 (NO) ..... 19982017

(51) Int. Cl.[7] ..... E21B 33/138; E21B 47/01

(52) U.S. Cl. ..... 166/250.17; 166/66; 166/285; 166/297; 166/378; 166/385; 166/387

(58) Field of Search ..... 166/55.1, 66, 250.17, 166/285, 297, 378, 385, 387

(56) References Cited

U.S. PATENT DOCUMENTS

| | | | | | |
|---|---|---|---|---|---|
| 4,074,756 | A | * | 2/1978 | Cooke, Jr. | 166/277 |
| 4,548,266 | A | * | 10/1985 | Burklund | 166/242.6 |
| 4,662,442 | A | * | 5/1987 | Debreuille | 166/250.01 |
| 4,744,416 | A | * | 5/1988 | Bower | 166/253.1 |
| 4,775,009 | A | * | 10/1988 | Wittrisch et al. | 166/250.11 |
| 4,950,995 | A | * | 8/1990 | Falk | 166/250.17 |
| 5,062,482 | A | * | 11/1991 | Graham | 166/100 |
| 5,303,773 | A | * | 4/1994 | Czernichow et al. | 166/242.6 |
| 5,350,018 | A | | 9/1994 | Sorem et al. | |
| 5,467,823 | A | * | 11/1995 | Babour et al. | 166/250.01 |
| 5,472,052 | A | | 12/1995 | Head | 166/298 |
| 6,230,800 | B1 | * | 5/2001 | Bryant | 166/250.01 |
| 6,325,161 | B1 | * | 12/2001 | Havig | 166/250.01 |

FOREIGN PATENT DOCUMENTS

| | | |
|---|---|---|
| GB | 2275282 | 8/1994 |
| GB | 2276723 | 10/1994 |
| GB | 2312454 | 10/1997 |
| NO | 965089 | 11/1996 |
| WO | WO99/63202 | 12/1999 |

* cited by examiner

*Primary Examiner*—George Suchfield
(74) *Attorney, Agent, or Firm*—Finnegan, Henderson, Farabow, Garrett, & Dunner, L.L.P.

(57) ABSTRACT

A method for plugging wells for use in connection with extraction of a fluid. Above a leakage site in the well, from which the fluid flows into the well from a subsurface formation surrounding the well, there is a set a seal (20), which seals the well, and on the bottom of which is a sensor device (22) for measuring well data. On the top of the seal (20) is a connecting part (24) which is connected to the sensor. Above the seal (20) the well is filled with a temperable, liquid sealant (32), into which is lowered via a cable (38) a connecting device (40) with a connecting part (42) until the connecting parts (24, 42) have been connected. Both the lowering and this connection are provided by means of the weight of the connecting device (40). The cable (38) is connected to a logging device (50) outside the well opening and the sealant (32) is set.

5 Claims, 8 Drawing Sheets

METHOD FOR INSTALLING A SENSOR IN CONNECTION WITH PLUGGING A WELL

BACKGROUND OF THE INVENTION

1. Field of the Invention

The invention relates to a method for plugging of wells for use in connection with recovery of a fluid, such as oil, gas or water.

2. Description of the Related Art

If the fluid comprises hydrocarbons, at present according to regulations plugged wells, such as offshore wells, of the above-mentioned type have to include two barriers or blocking devices which must be installed between a formation from which the hydrocarbons flow into the well and the space above the well in order to prevent hydrocarbons from leaking out of the well. For this purpose a first barrier may be employed in the form of a mechanical seal and a second barrier in the form of a mortar which is applied over the seal.

In order to apply the mortar securely, a drill string is first inserted in the well until its lower end is located near the seal. The mortar is then pumped down into the well through the drill string while the drill string is pulled up at a rate which is adapted to the rate at which the mortar is pumped down.

Even though wells are abandoned and permanently and satisfactorily secured or plugged in this manner, there may be a need for monitoring of the well, i.e. a continuous logging of well data such as pressure, temperature, electrical properties of well components, etc. Such monitoring is not possible, however, with plugging in the above-mentioned manner, since any electrical wires extending in the well from sensors which have been mounted at the bottom of the well to a logging device on the seabed at the well would have been destroyed by the drill string before or during the casting.

SUMMARY OF THE INVENTION

The object of the invention is to provide a method whereby a well of the above-mentioned type can be secured according to regulations while at the same time the well is monitored by means of sensors.

The invention relates to method for providing at least one sensor in a well at a location where a well fluid flows into the well from a subsurface formation surrounding the well, the sensor establishing a well parameter required to be monitored after the well is plugged. The method comprises the steps of connecting the sensor to the bottom of a first seal having a first connecting part on the top thereof, the sensor and the first connecting part being connected for transferring signals from the sensor to the first connecting part, placing the first seal above the location to plug the well, filling the well above the first seal with a temporarily liquid, settable sealant in an amount of the sealant so that the sealant alone plugs the well after it has set. Before the sealant has set, a first connecting device with a fourth connecting part is lowered into the sealant, the first connecting device being suspended on a cable, and the fourth connecting part is connected to the first connecting part, both the lowering and the connection of the fourth connecting part to the first connecting part being provided by the weight of the first connecting device. The cable is then connected to a logging device outside the well so that after the sealant is set, signals from the sensor are transferable to the logging device via the first connecting part of the first seal, the fourth connecting part, and the cable.

BRIEF DESCRIPTION OF THE DRAWINGS

The invention will now be described in more detail with reference to the drawing which schematically illustrates different stages during the plugging of wells of different types which are provided with a such equipment.

DETAILED DESCRIPTION OF THE ILLUSTRATED EMBODIMENTS

In the course of th e following description various stages of a method for plugging of an exploration well will be explained in more detail in association with FIGS. 1–5, while methods for plugging of production wells will be described in association with FIGS. 6–13.

Figure 1:
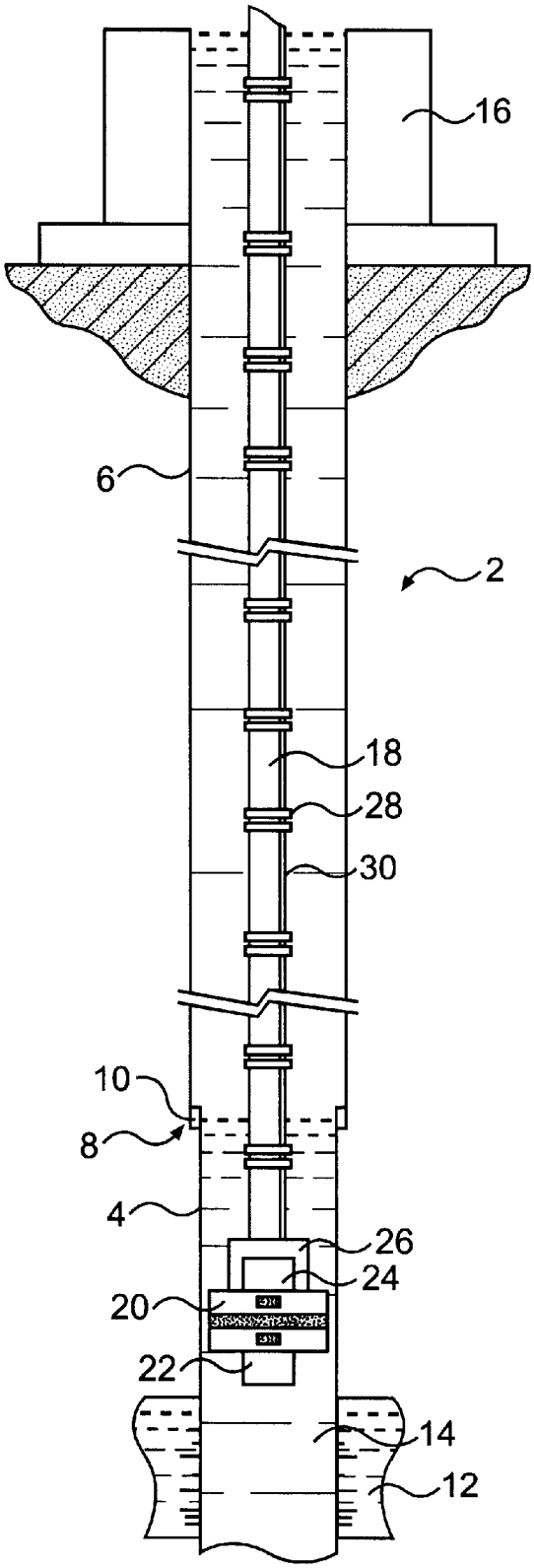
FIG. 1 shows a longitudinal section through an exploration well after a first stage during a plugging of the well.

In FIG. 1 there is illustrated an exploration well 2 wherein there are provided an upper, second casing 6 and a lower, first casing 4. Between the casings there is a joint 8, wherein there is provided a first annulus seal 10. The lower casing 4 projects down into a hydrocarbon-carrying formation 12 from which hydrocarbons 14 can flow into it via holes in the first casing 4. At the upper portion of the well a bottom installation 16 is installed on the seabed.

The simplest method of plugging the well is to seal it above the joint 8, while at the same time providing sensors for monitoring the well after plugging.

As illustrated in FIG. 1, to the lower end portion of a drill string 18 which has been inserted into the well there has been attached a first, mechanical, expandable seal 20 with a known per se design and function, which can be expanded, e.g., by an increase in the pressure of a fluid in the drill string or the like. On the bottom of the seal 20 there is a sensor device 22 comprising a number of sensors (not shown) for continuous measurement of the extent of various measurement parameters for the formation area outside the well and for the hydrocarbons which are located there. On the top of the seal 20 there is a first mechanical connecting part 24 which is releasably connected to a second mechanical connecting part 26, which is attached to the drill string 18.

Along the drill string 18 holders 28 are attached at intervals for a wire 30 for remotely controlled mutual locking or release of the connecting parts 24,26. The connecting part 24 also comprises a first electrical connecting part from which extend wires to the respective sensors of the sensor device 22.

Figure 2:
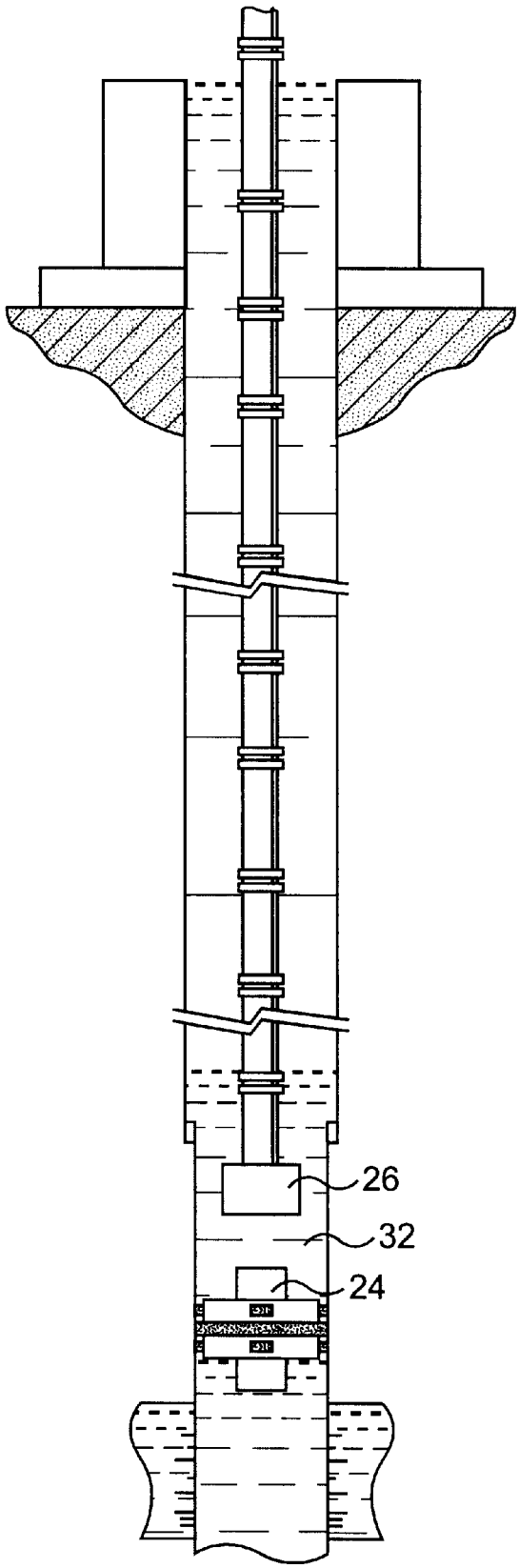
FIGS. 2–4 show longitudinal sections through the exploration well according to FIG. 1 after respective, successive intermediate stages during the plugging of the well.

FIG. 2 shows that the first mechanical seal 20 has been placed in the second casing 6 under the joint 8 and that the connecting parts 24, 26 have been separated. The drill string 18 has been pulled up a short distance and through it a temporarily liquid, settable sealant 32 has been introduced. The amount of this sealant is so great that its surface will be located above the joint 8 when the drill string has been pulled up from the sealant.

Figure 3:
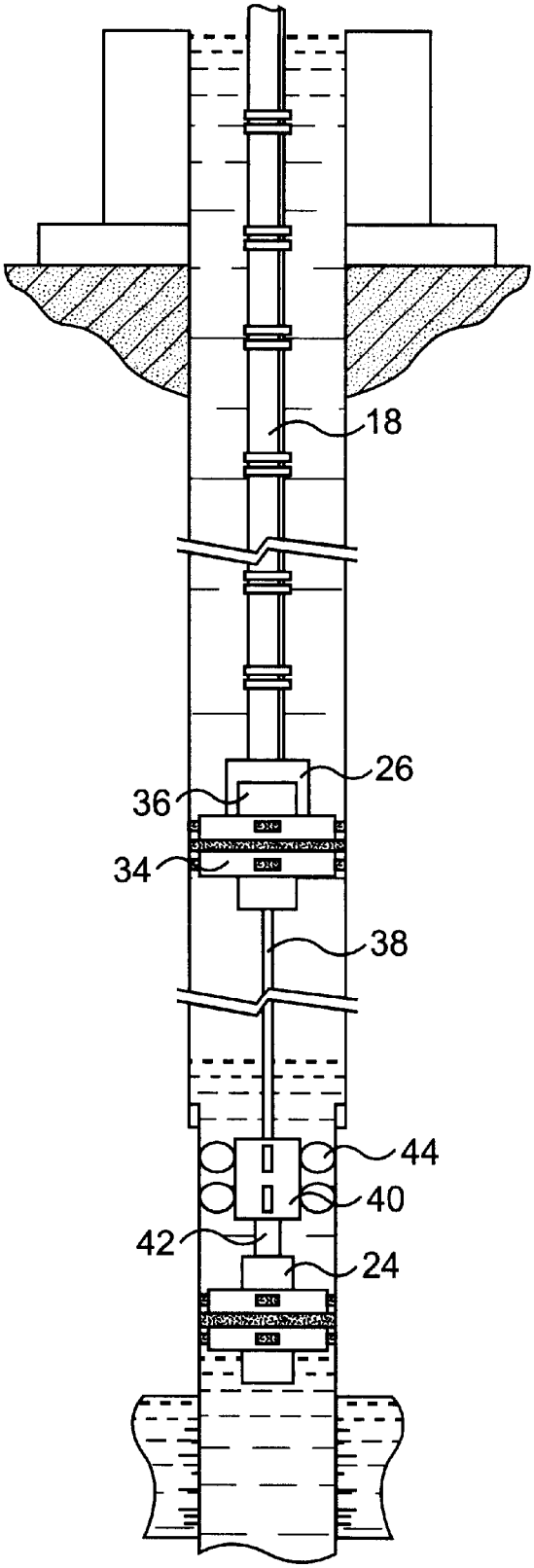

We now refer to FIG. 3. After the drill string has been withdrawn from the well, a second mechanical seal 34 is releasably attached to the second connecting part 26 via a third mechanical connecting part 36. On the bottom of the second seal 34 there is a wire 38 wherein there is suspended a first connecting device 40. On the bottom of this connecting device 40 there is a fourth mechanical connecting part 42. The wire 38 comprises electrical wires for transferring sensor data and a wire for transferring signals from a location above the well for mutual locking or releasing of the first connecting part 24 and the fourth connecting part 42.

When the drill string 18 is lowered into the well 2, the connecting device 40 is inserted into the not yet set, liquid sealant 32, the connecting device 40 being steered in the first casing 4 via a suitable steering device, e.g. a wheel 44 of the connecting device 40 which is arranged to abut against the inside of the first casing 4 and possibly a device (not shown) for mounting the connecting device 40 in a fixed angular position calculated about the well's longitudinal axis. The connecting device 40 is hereby lowered into the sealant by its own weight until the fourth and the first connecting parts 42, 24 have been brought into a relative position wherein they can be locked to each other. In this position electrical wires of the wire 38 have also been brought into electrically conductive connection with the corresponding wires from the sensors of the sensor device 22 in the first connecting part 24. Th rough the second mechanical seal 34 there extend corresponding wires to electrical connection components of the third connection 36.

After the fourth and the first connecting parts 42, 24 have been locked to each other, and the second and the third connecting parts 26, 36 have been released from each other, the drill string 18 is withdrawn from the well.

The sealant 32 can now set.

Figure 4:
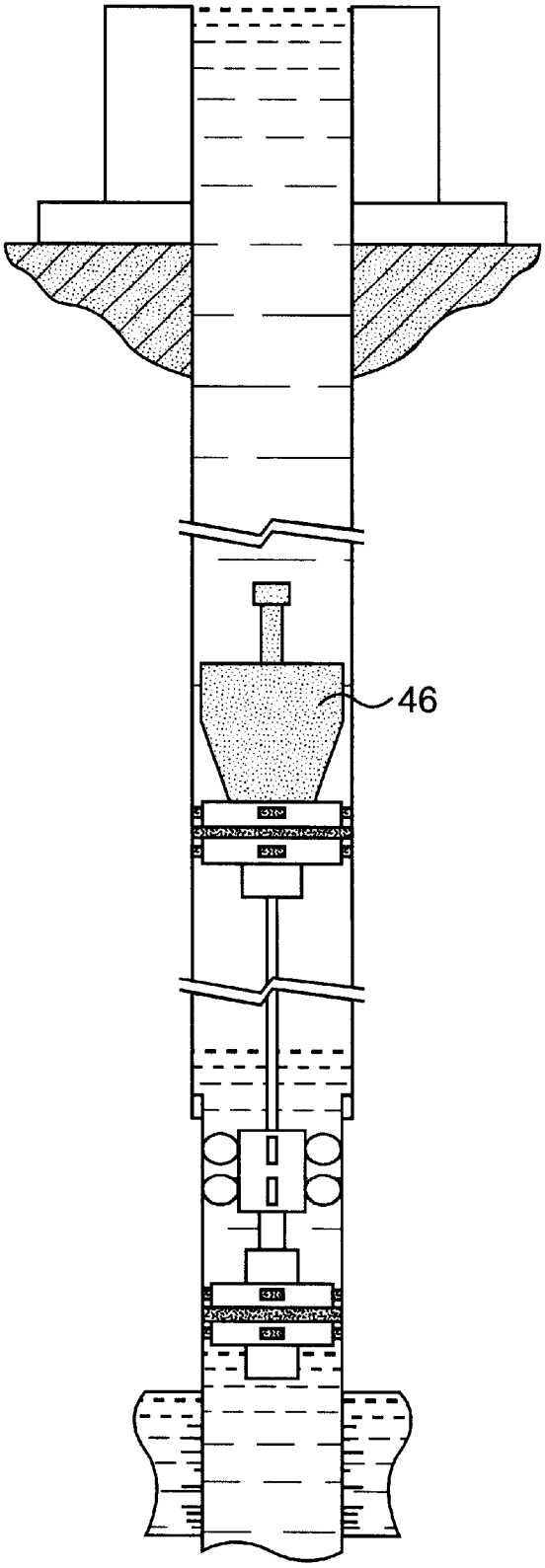

To the drill string's second connecting part 26 there is now affixed a junk basket 46 which is lowered into the well until it rests on the second mechanical seal 34 as illustrated in FIG. 4.

Figure 5:
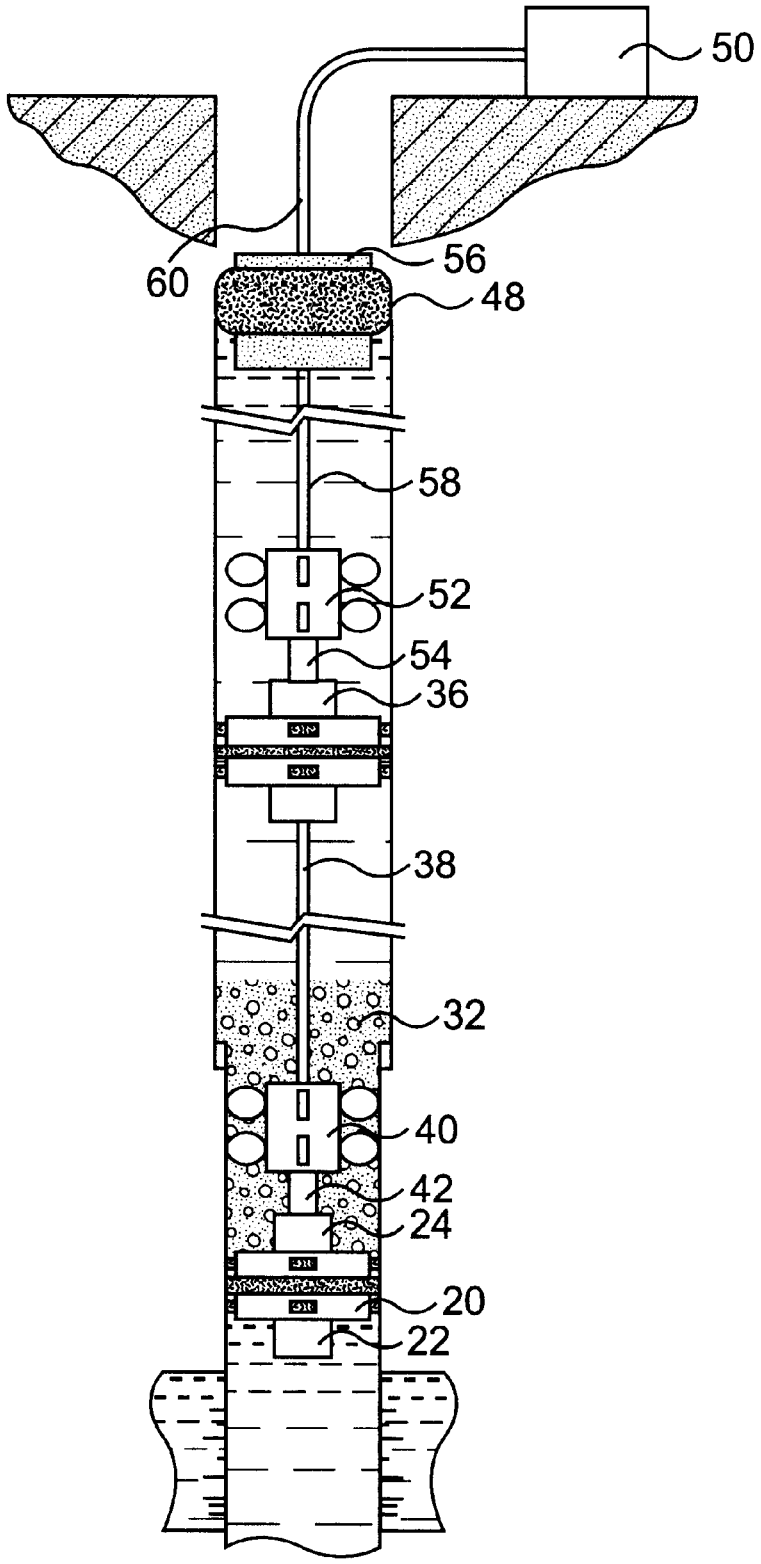
FIG. 5 shows a longitudinal section through the exploration well according to FIG. 1 after a final stage of the plugging of the well.

The well head is then removed, and an upper portion of the first casing is removed, e.g. by means of a milling tool. Metal shavings which fall down into the well are hereby collected in the junk basket 46. The junk basket is then lifted out of the well by means of the drill string. Down in the first casing in the well there is lowered by means of the drill string 18 and mounted near the well opening an inflatable seal 48, which abuts against the surrounding formation, as illustrated in FIG. 5. In the same way as in the second mechanical seal 34, this third seal 48 carries on its lower side via a cable 58 a second connecting device 52 with a fifth, mechanical connecting part 54 which, during the lowering of the inflatable seal 48, is connected to the third mechanical connecting part 36. Finally there is mounted on the seabed a logging device 50 which is connected via a cable 60 to a sixth, mechanical connecting part 56 which is mounted on the top of the inflatable seal 48, via which signals from the sensor device can be transferred to the logging device.

The well has now been permanently and securely plugged, since there have been mounted above the lower end portion of the first casing 4 two sealing devices, viz. the first mechanical seal 20 and the set sealant 32. Moreover, above the joint 8 between the two casings 4, 6 there have also been provided two sealing devices, viz. the sealant 32 and the second mechanical seal 34. At the top of the well there has been mounted an inflatable seal 48 which prevents objects from dropping into lower portions of the well. In addition, sensors have been provided at the bottom of the well for constant monitoring of the well. Furthermore, on the seabed at the well there has been installed a logging device 50 from which values of the well parameters which are logged can be derived.

The principle of the method according to the invention, therefore, is that above a location in the well where oil or gas flows thereinto from the surrounding formation, there is provided a seal on the bottom or the lower side of which is mounted at least one sensor for the establishment of at least one well parameter which requires to be monitored. A wire for transferring signals from this sensor extends through the seal to a connecting part on the top or the upper side thereof. Above this seal there is applied a temporarily liquid, settable sealant wherein there is lowered a connecting device with a connecting part which is arranged for connection with the former connecting part. From the connecting device there extends up through and out of the well a cable for further transfer of the signals from the sensor to a logging device, from which the signals can be retrieved when desired. Thus above the leakage site there have been mounted two sealing devices which securely and permanently seal the well, while at the same time ensuring that the well can be continuously monitored.

The connecting device is preferably inserted in the well suspended in a suspension device. This suspension device may be an additional mechanical seal which may be affixed in the well above the former mechanical seal, and via which the signals are transferred to the cable which extends to the logging device. The mechanical seal may be of the same type as that which carries the sensor device. According to a second embodiment it may be an inflatable seal. Furthermore, it may be a device which does not provide any sealing, but which is only arranged to securely grip a portion of the formation, the casing or the production tubing above the sealing site, its purpose being to ensure that the connecting device is properly inserted in the well and/or to relieve the pressure on the cable.

The connecting parts which are arranged to be cast in the sealant may be provided with passages or openings via which sealant can be expelled during the joining of the connecting parts.

FIGS. 6–10 illustrate further possibilities for use of the above-mentioned principle in connection with various well designs. For corresponding components the same reference numerals will be employed as in FIGS. 1–5.

Figure 6:
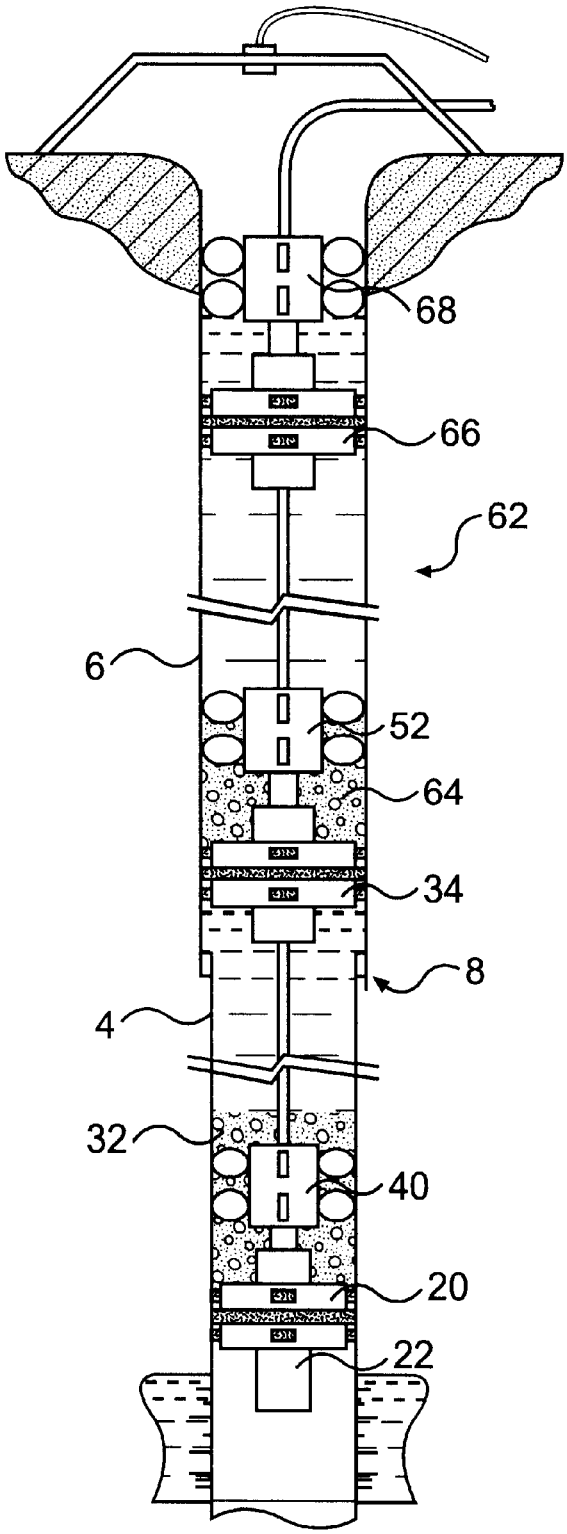
FIG. 6 shows a longitudinal section through a production well after a final stage of a plugging of the well, a production tubing having been completely removed.

FIG. 6 illustrates a production well 62 which has been permanently plugged, the production tubing which was employed during production having been removed in its entirety.

In this case there has been mounted in the lower portion of the first casing 4 a double seal in the form of a first mechanical seal 20 and a set sealant 32, wherein there is cast a first connecting device 40, where signals can be transferred via this and a cable from sensors under the first seal 20 to a second seal 34 which is provided in the second casing 6. The sealant 32, however, does not extend up to the joint 8 between the first and the second casings 4, 6. For this reason above the second seal 34 there has been applied additional sealant 64 wherein the second connecting device 52 has been cast. In this case, however, the upper portion of the second casing has not been removed as was the case with the well which is illustrated in FIG. 5, with the result that this connecting device 52 has been mounted in the well, having been suspended in the drill string via a fourth mechanical seal 66 of the same type as the first and the second mechanical seal, instead of an inflatable seal. The fourth mechanical seal 66 thus abuts with its sealing element against the radially internal surface of the second casing 6. A logging device (not shown) on the seabed is connected to this seal 66 via a third connecting device 68 which is connected to the fourth mechanical seal 66, and via which signals from the sensor device 20 can be transferred.

This embodiment may be chosen if there is a very great distance between the lower portion of the first casing and the joint 8 between the casings, in which case there is a need for a smaller amount of the relatively expensive sealant.

Figure 7:
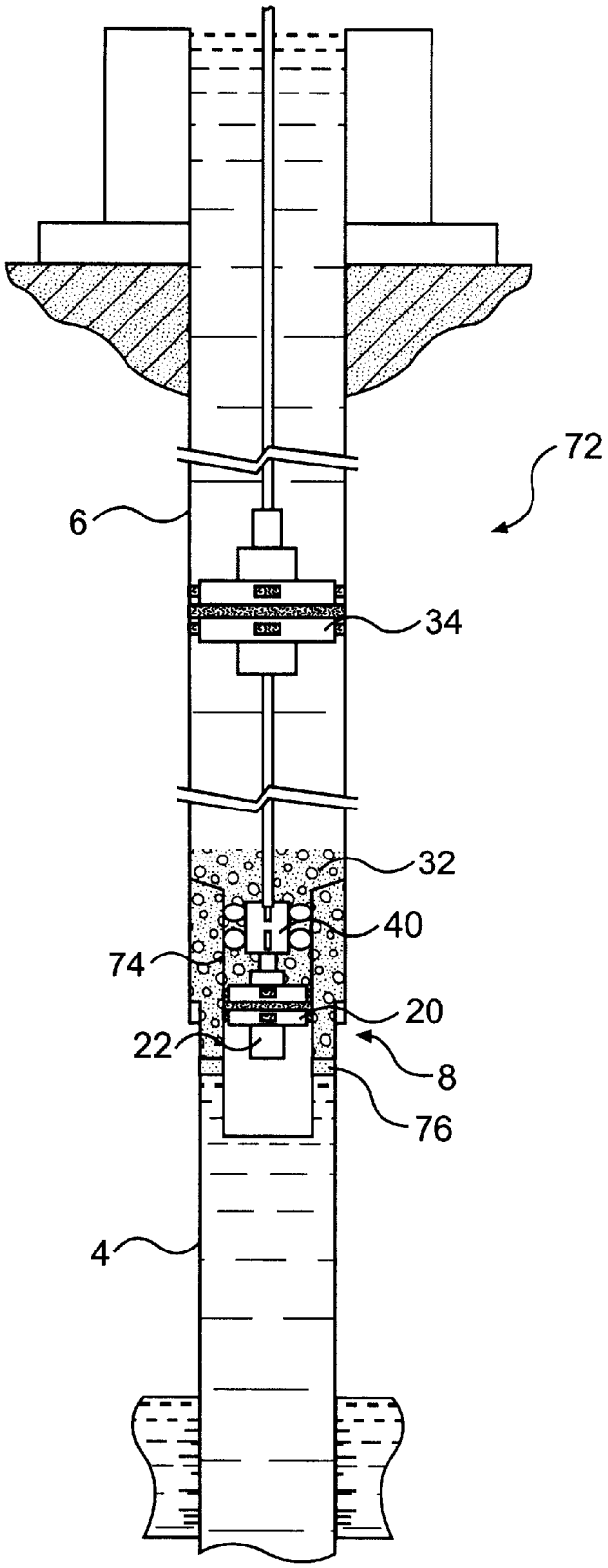
FIG. 7 shows a longitudinal section through a production well after a final stage of a plugging of the well, a lower portion of the production tubing having been left in the well.

FIG. 7 illustrates a production well 72 where between the production tubing and the first casing 4 there is provided a second annulus seal 76. For plugging of the well an upper portion of the production tubing has been removed, with the result that in the well there is only a portion 74 thereof immediately above and below the joint 8 between the first and the second casings 4, 6. The removal of the upper portion of the production tubing has been implemented by lowering a milling tool into the production tubing by means of a drill string, and cutting the production tubing by means of this tool, whereupon the milling tool and the released, upper portion of the production tubing have been withdrawn from the well. In the remaining production tubing portion 74 there has been mounted a first, mechanical seal 20 with a sensor device 22 and a first connecting device 40 connected to the seal 20, which device is suspended via a cable in a second mechanical seal 34 which is fixed in the second casing 6. If any difficulty should arise in connection with the insertion of the connecting device 40 in the production tubing portion 74 as a result of inadequate relative centering of the connecting device 40 and the production tubing portion 74, a centering device may be used of the type which will be described in connection with FIG. 11.

In the production tubing portion 74 above the seal 20 and between the first and second casings 4, 6 and the production tubing portion above the annulus seal 76 there has been applied a temporarily liquid, settable sealant 32 to a level above the upper end of the production tubing portion 74. From the second mechanical seal 34 there extends a cable to a logging device on the seabed for receipt of signals from the sensor device 22.

Figure 8:
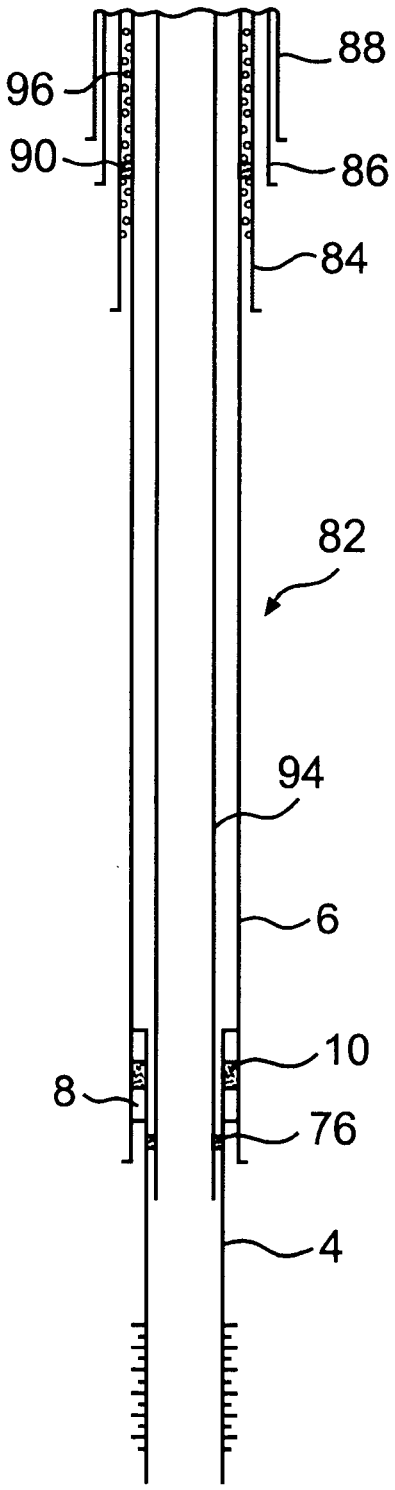
FIG. 8 shows a longitudinal section through a production well before a plugging.

In FIG. 8 there is illustrated a production well 82 with a second casing 6 which extends from the seabed down into the well, and a first casing 4 which extends from the lower portion of the second casing 6 to the bottom of the well, with an annular overlapping area or a joint 8 between these casings, wherein there is provided the first annulus seal 10. Through the casings there extends a production tubing 94. Between the first casing 4 and the production tubing 94 a second annular seal 76 is provided in the overlapping area for the casings.

In the well a third casing 84 is further mounted on the outside of the second casing 6, a fourth casing 86 on the outside of the third casing 84, and a fifth 'casing 88 on the outside of the fourth casing 86. These casings 88, 86, 84' extend from the surface of the sea and the second, third and fourth casings extend to a depth which is greater than the depth to which the casing located immediately outside extends.

It is indicated by small circles which are intended to symbolise hydrocarbon amounts 96 that between the first and the third casings 4 and 84 respectively there is a leakage from a formation portion below the third casing 84 from the well, e.g. because a third annular seal 90 has failed.

Figure 9:
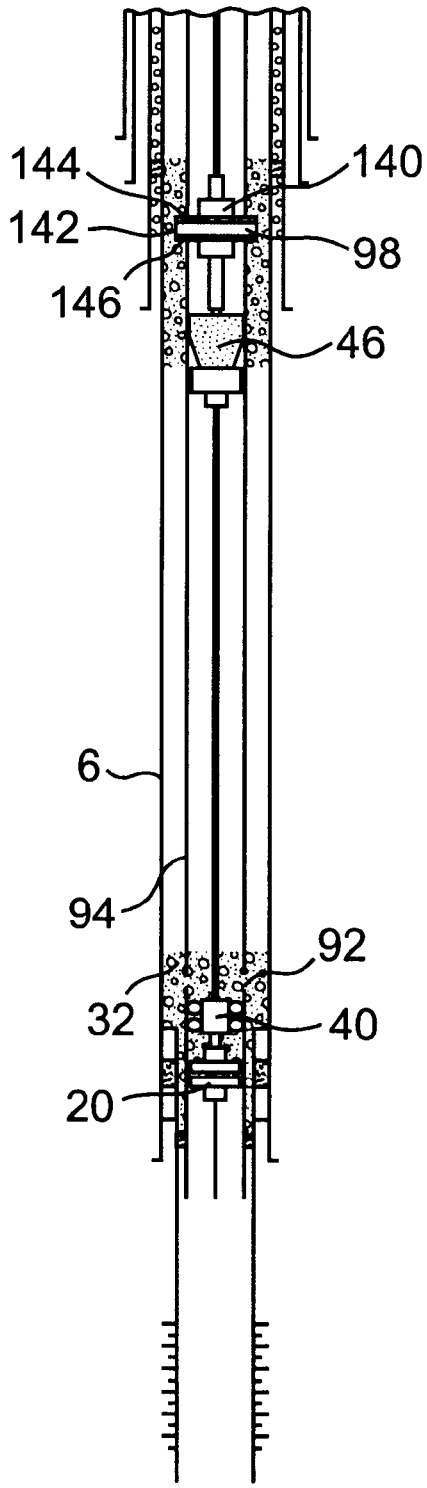
FIGS. 9–11 shows a longitudinal section through the well which is illustrated in FIG. 8 during stages before final plugging.

A plugging of this well can be implemented in the manner illustrated in FIG. 9.

The lower area of the well can be plugged by initially mounting a first, mechanical seal 20 in the production tubing 94 near the joint 8. Holes 92 are then made in the production tubing 94 above the seal 20. In order to prevent shavings and the like from hereby dropping on to the seal 20, before this perforation is performed a junk basket (not shown) can be installed above the seal 20 by means of the drill string, this junk basket being removed after the perforation is completed.

A temporarily liquid, settable sealant 32 is then applied above the first seal 20, this sealant filling the production tubing to a certain distance above the holes 92, thus causing the sealant to also flow out into the annulus between the production tubing 94 and the second casing 6.

Before the sealant has set, a second mechanical seal 34 is inserted in the production tubing by means of the drill string, which seal via a cable 38 carries a first connecting device 40 which is connected to the first seal 20. After the sealant has set, together with the mechanical seal 20 and the annulus seal 10 this forms a double sealing device at the bottom of the well above the location from which hydrocarbons have been recovered during production.

The upper area of the well where a leak exists can be sealed in the following way.

Figure 10:
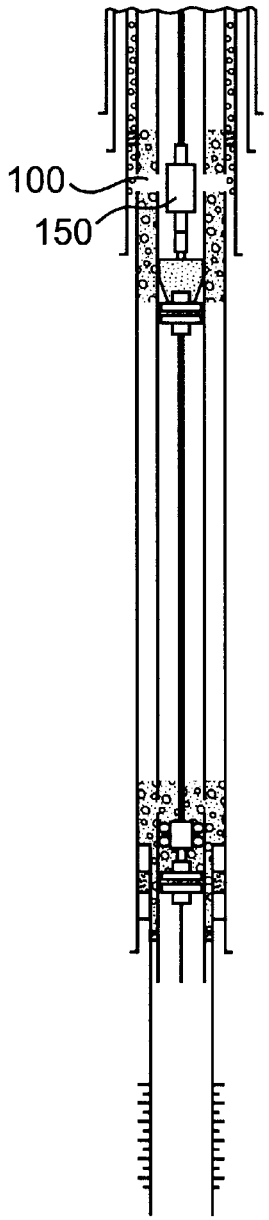
Figure 11:
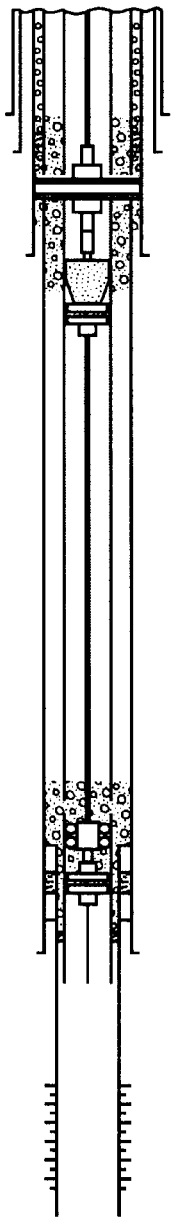
Figure 12:
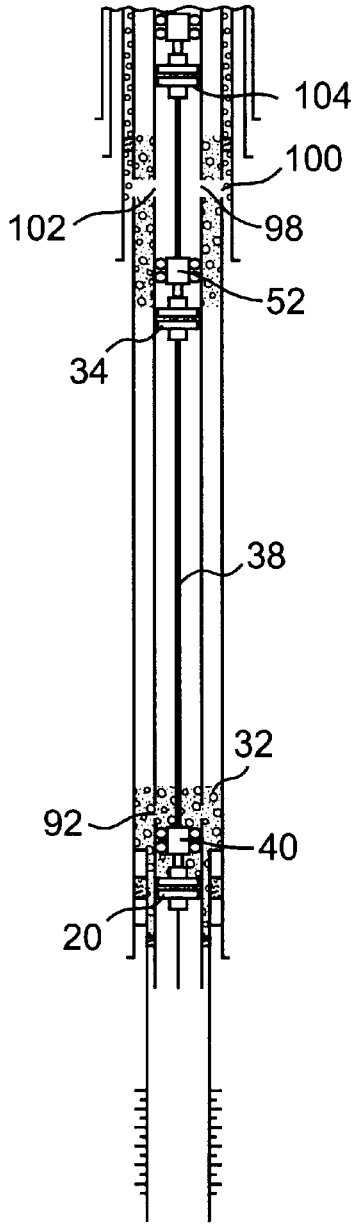
FIG. 12 shows a longitudinal section through the well which is illustrated in FIG. 8 after final plugging, the entire production tubing having been left in the well.

In the same way as mentioned above, a junk basket 46 may be installed above the second mechanical seal 34 and holes 98 made in the production tubing 94 by means of a suitable tool such as a pyrotechnic lance 150 which is illustrated in FIG. 10. By means of the drill string and an injection tool 140 connected thereto a temporarily liquid, settable sealant is then injected between the production tubing 94 and the second casing 6 as illustrated in FIG. 9. This injection tool 140 comprises radially extending nozzles 142 and a sealing ring 144 above and a sealing ring 146 below the nozzles. These sealing rings abut against the internal surface of the production tubing 94, preventing it from being filled with sealant. Before it has set, this sealant has such a high degree of viscosity that it seeps only a short distance downwards after having been inserted in the annulus between the production tubing 94 and the second casing 6.

The injection tool 140 is then lifted out of the well and after this sealant has set, additional holes 100 are made through the sealant, the production tubing 94 and the second casing 6 by means of the lance 150, as illustrated in FIG. 10.

The lance 150 is then removed and the injection tool 140 again inserted into the well, with the holes 100 in the production tubing and the second casing 6 aligned with the nozzles 142, whereupon the annulus between the second casing 6 and the third casing 84 above and below the holes 148 are filled via the holes 100 with sealant with increased viscosity.

Once again the injection tool 140 is lifted out of the well. This tool is then disconnected from the drill string and a less viscous, temporarily liquid, settable sealant material is inserted in the production tubing 94, with the result that this material extends slightly above the holes 100.

A second connecting device 52 is then lowered into the sealant and connected to the second mechanical seal 34. The connecting device 52 is suspended in a fourth mechanical seal 104 which has been mounted or set by means of the drill string 94. As mentioned above, all the casings can now be cut off a short distance under the seabed.

A logging device (not shown) which is installed on the seabed is then connected to a connecting part of the third mechanical seal 104, thus enabling signals to be transferred from the sensor device below the first mechanical seal 20 the logging device. In the formation above the casings, an inflatable seal may also be provided.

Figure 13:
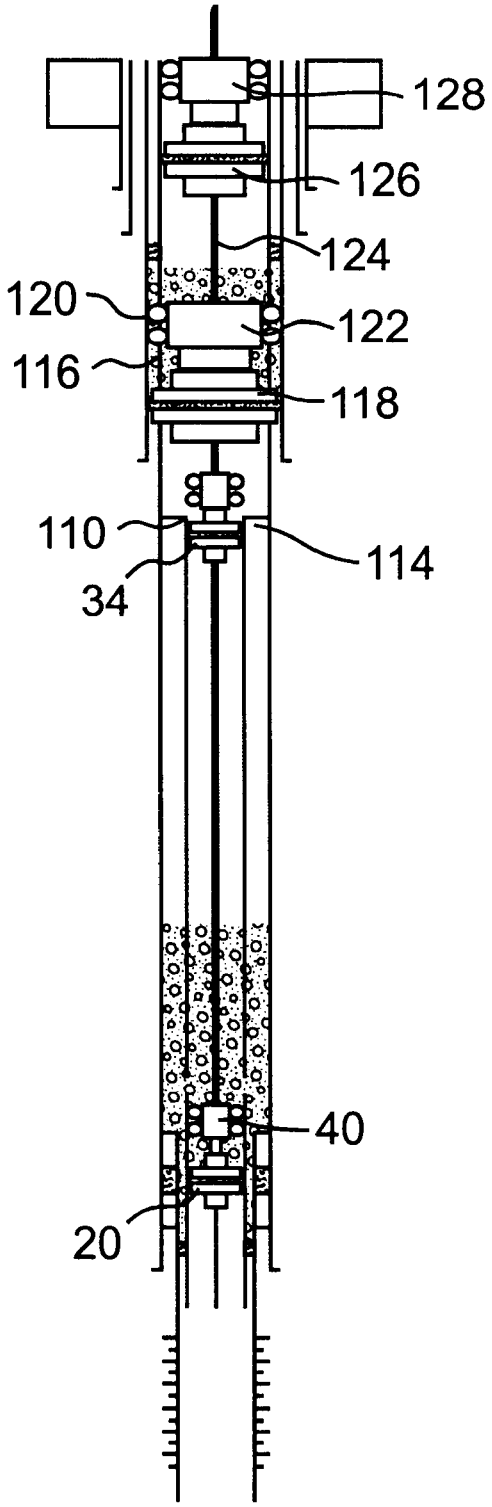
FIG. 13 illustrates a longitudinal section through a production well of the type which is illustrated in FIG. 8, after final plugging of the well, an upper portion of the production tubing, an upper portion of a first casing and an intermediate portion of a second casing having been removed.

The upper area of the well which is illustrated in FIG. 8 may, instead of being 1 plugged in the manner illustrated in FIGS. 9–12, be plugged in the manner illustrated in FIG. 13.

Before mounting the second seal 34, by means of a milling device (not shown) which has been mounted on the drill string 18 the production tubing 94 is hereby cut at a point 110, which is located near the lower end of the third casing 84. The upper, cut-off portion of the production tubing is removed from the well.

Since the upper end portion of the remaining production tubing 94 may thereby extend eccentrically in the well and, e.g., lean against the inside of the second casing 6, by means of the drill string a centering device 114 may be provided round and under the incision point 110 for the casing, whereupon, the second seal 34 may be placed in the production tubing and the first connecting device 40 may be connected to the first seal 20.

A portion of the second casing 6 which is located above the incision point 110 for the production tubing 94 is then removed, thus forming here a circumferential opening 116 in this casing. In addition holes 120 may be made in the third casing 84 radially outside the opening 116.

By means of the drill string a fifth mechanical seal 118 is placed in the third casing 84 below the opening 116, and above this seal 118 the well is filled with a temporarily liquid, settable sealant which fills the opening 116, and which may flow out through the holes 120, filling the annulus between the third casing 84 and the formation radially outside this casing. The fifth mechanical seal 118 has a connecting part which is connected to a connecting part of the second mechanical seal 34 for transferring signals from the signal device in the above-mentioned manner.

Before the sealant has set, a third connecting device 122 is connected to the fifth mechanical seal 118. This connecting device 122 is suspended in a cable 124 below a sixth mechanical seal 126 which has been placed or set in the upper portion of the second casing 6, by means of the drill string. This seal 126 is connected via a fourth connecting device 128 to a logging device on the seabed for receipt of data from the sensor device.

Even though it has been stated in the above that additional seals have been provided above the first seal, and that cable portions extend between these, it will be understood that if there is no need for the additional seals, a single cable may extend above this seal from the first seal to the logging device.

The invention has been described above in connection with wells for use in extraction of a fluid. It will be understood that this expression refers to wells which have been used or are being used for production of the fluid, as well as for injection of a fluid in addition to exploration or test wells. Furthermore, the expression should be understood to refer to wells which have exclusively been used or are being used as observation wells.

What is claimed is:

1. A method for providing at least one sensor in a well at a location where a well fluid flows into the well from a subsurface formation surrounding the well, the sensor establishing a well parameter required to be monitored after the well is plugged, comprising:

connecting the sensor to the bottom of a first seal having a first connecting part on the top thereof, the sensor and the first connecting part being connected for transferring signals from the sensor to the first connecting part, placing the first seal above the location to plug the well, filling the well above the first seal with a temporarily liquid, settable sealant in an amount of the sealant so that the sealant alone plugs the well after it has set, before the sealant has set, lowering a first connecting device with a fourth connecting part into the sealant, the first connecting device being suspended on a cable, and connecting the fourth connecting part the first connecting part, both the lowering and the connection of the fourth connecting part to the first connecting part being provided by the weight of the first connecting device, and connecting the cable to a logging device outside the well so that after the sealant is set, signals from the sensor are transferable to the logging device via the first connecting part of the first seal, the fourth connecting part, and the cable.

2. A method according to claim 1, wherein the cable comprises at least a first cable portion and a second cable portion, the first connecting device being lowered while being suspended via the first cable portion in a second seal, and including placing the second seal in the well to be spaced above the first seal after the interconnection of the first connecting part and the fourth connecting part connecting a third connecting part on the top of the second seal to the first cable portion for transferring signals from the first cable portion to the third connecting part, lowering into the well a second connecting device with a fifth connecting part suspended on the second cable portion, until the fifth connecting part is connected to the third connecting part, both the lowering and connection of the third and fifth connecting parts being provided by the weight of the second connecting device, and connecting the second cable portion to the logging device.

3. A method according to claim 1, including filling a temporarily liquid, settable sealant above the second seal before the second connecting device is lowered into the well, a leakage point, through which the fluid can flow into the well, being located between the set liquid sealant over the first seal and the second seal.

4. A method according to one of claims 1 and 2, including perforating or cutting an upper portion of a production tubing extending in the well immediately above a first leakage site, the first seal being set in the production tubing or the remaining portion thereof, and filling the sealant also in an annulus between the production tubing or production tubing portion and a well wall extending radially outside of the production tubing or production tubing portion.

5. A method according to one of claims 1 and 2, including removing or perforating a portion of at least one casing provided in the well, and filling sealant also radially outwards to a boundary sealed or tight in the radial direction of the well.

* * * * *